US011465166B2

(12) United States Patent
Wada et al.

(10) Patent No.: US 11,465,166 B2
(45) Date of Patent: Oct. 11, 2022

(54) VISCOUS MATERIAL APPLICATION APPARATUS

(71) Applicant: MITSUBISHI HEAVY INDUSTRIES, LTD., Tokyo (JP)

(72) Inventors: Jiro Wada, Tokyo (JP); Michinobu Takahagi, Tokyo (JP); Yasumasa Sugekawa, Tokyo (JP); Akira Ikada, Tokyo (JP); Yuki Tsukioka, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/269,594

(22) PCT Filed: Apr. 8, 2019

(86) PCT No.: PCT/JP2019/015284
§ 371 (c)(1),
(2) Date: Feb. 19, 2021

(87) PCT Pub. No.: WO2020/054113
PCT Pub. Date: Mar. 19, 2020

(65) Prior Publication Data

US 2021/0308713 A1 Oct. 7, 2021

(30) Foreign Application Priority Data

Sep. 13, 2018 (JP) ..... JP2018-171525

(51) Int. Cl.
*B05C 5/02* (2006.01)
*B05B 13/02* (2006.01)

(52) U.S. Cl.
CPC ..... *B05C 5/02* (2013.01); *B05B 13/0207* (2013.01)

(58) Field of Classification Search
None
See application file for complete search history.

(56) References Cited

U.S. PATENT DOCUMENTS 421,362 A * 2/1890 Underwood ..... B43K 5/1845 401/264
4,961,965 A * 10/1990 Dietz ..... B05C 5/0216 118/410

(Continued)

FOREIGN PATENT DOCUMENTS

JP H06315659 * 11/1994
JP H1157598 A 3/1999

(Continued)

OTHER PUBLICATIONS

English translation of JPH06315659.*
International Search Report of International Application No. PCT/JP2019/015284 dated May 7, 2019; 5pp.

*Primary Examiner* — Charles Capozzi
(74) *Attorney, Agent, or Firm* — Kanesaka Berner and Partners LLP

(57) ABSTRACT

The purpose of the present invention is to provide a viscous material application apparatus capable of reliably applying an appropriate amount of a viscous material to a shaft-shaped member. A seal application apparatus (1) is provided with a flexible tubular nozzle (2), which is capable of discharging a sealing agent from an opening (6) formed on the tip thereof, and an actuator (3) for moving the nozzle (2). After or during discharge of the sealing agent by the nozzle (2), the tip of the nozzle (2) moves in the circumferential direction along the outer circumferential surface of a fastener (20), and as the nozzle (2) is stopping the discharge of the sealing agent, the tip of the nozzle (2) moves in a direction away from the outer circumferential surface of the fastener (20).

2 Claims, 7 Drawing Sheets

(56) References Cited

U.S. PATENT DOCUMENTS

| | | | | |
|---|---|---|---|---|
| 6,071,347 | A * | 6/2000 | Ogawa | H05B 3/0095 118/712 |
| 2004/0258459 | A1* | 12/2004 | Esmoris | A45D 26/0014 401/265 |
| 2005/0034656 | A1* | 2/2005 | Park | B05C 5/027 118/304 |
| 2011/0089192 | A1 | 4/2011 | McMahon et al. | |
| 2017/0014860 | A1* | 1/2017 | Kurosaki | B05C 5/0208 |

FOREIGN PATENT DOCUMENTS

| | | | |
|---|---|---|---|
| JP | 2000093867 | A | 4/2000 |
| JP | 2012239994 | A | 12/2012 |
| JP | 2014105714 | A | 6/2014 |
| WO | 2015145950 | A1 | 10/2015 |

* cited by examiner

VISCOUS MATERIAL APPLICATION APPARATUS

RELATED APPLICATIONS

The present application is a National Phase of International Application Number PCT/JP2019/015284 filed Apr. 8, 2019 and claims priority to Japanese Application Number 2018-171525 filed Sep. 13, 2018.

TECHNICAL FIELD

The present invention relates to a viscous material application apparatus.

BACKGROUND ART

When manufacturing aircraft parts such as a fuselage panel or a main wing, a fastening part (fastener) such as a rivet is used in order to join members such as skins, frames, and stringers together. When the fastener is installed in and fastened to the member, a gap between the fastener and a fastener installation hole is filled with a sealing agent, whereby the corrosion resistance of the manufactured aircraft part can be enhanced.

PTL 1 below discloses a technique relating to a seal application apparatus in which application is performed by discharging a sealing agent from a nozzle while rotating a fastener around a central axis thereof and moving the nozzle parallel to an axial direction of the fastener.

CITATION LIST

Patent Literature

[PTL 1] Japanese Unexamined Patent Application Publication No. 2012-239994

SUMMARY OF INVENTION

Technical Problem

As fastening apparatuses which are used when fastening (riveting) a rivet, bolt or other fastener to a member, there are fastening apparatuses in which a plurality of fasteners are filled in advance, so that fastening can be continuously performed in a short time. These apparatuses are called automatic fastening apparatuses (automatic riveters) or the like. The seal application apparatus disclosed in the above PTL 1 requires a mechanism for rotating the fastener around the central axis thereof and is difficult to be mounted on the automatic fastening apparatus. Therefore, it is conceivable that the fastener coated with the sealing agent in advance is loaded into the automatic fastening apparatus. However, since insertion or supply of the fastener cannot be smoothly performed due to the sealing agent applied thereto, it is not realistic.

Further, there is a seal application apparatus which is disposed at the tip position of an automatic fastening apparatus and coats a fastener before fastening with a sealing agent in dots by pressing the sealing agent which is discharged from a nozzle against the fastener surface. This apparatus can be mounted to the automatic fastening apparatus. Further, since the sealing agent is applied immediately before the fastening, the insertion or supply of the fastener is not hindered by the sealing agent. However, when the application of the sealing agent was actually performed using the seal application apparatus, it was found that there was a problem in that the sealing agent adhered to the tip of the nozzle drips when separating the nozzle from the fastener surface. In a case where the sealing agent drips and adheres to an area where the application of the sealing agent is unnecessary or prohibited, the fastening strength of the members by the fastener is reduced.

On the other hand, in a case where the amount of the sealing agent to be discharged is reduced in advance in consideration of the occurrence of dripping of the sealing agent, there is a case where the sealing agent cannot be sufficiently applied. Therefore, it is required that an appropriate amount of sealing agent can be applied always.

The present invention has been made in view of such circumstances and has an object to provide a viscous material application apparatus in which it is possible to reliably coat a shaft-shaped member with a viscous material in an appropriate amount.

Solution to Problem

According to an aspect of the present invention, there is provided a viscous material application apparatus including: a tubular nozzle part having flexibility and capable of discharging a viscous material from an opening formed at a tip thereof; and a drive part that moves the nozzle part, in which after or while the nozzle part discharges the viscous material, the tip of the nozzle part moves in a circumferential direction along an outer peripheral surface of a shaft-shaped member, and while the nozzle part stops discharge of the viscous material, the tip of the nozzle part moves in a direction away from the outer peripheral surface of the shaft-shaped member.

According to this configuration, the nozzle part capable of discharging the viscous material from the opening formed at the tip thereof is moved by the drive part. Since the nozzle part has flexibility, the tip of the nozzle part can move in the circumferential direction along the outer peripheral surface of the shaft-shaped member while being constantly pressed against the outer peripheral surface of the shaft-shaped member. After or while the nozzle part discharges the viscous material, the tip of the nozzle part moves in the circumferential direction along the outer peripheral surface of the shaft-shaped member, whereby the discharged viscous material is applied in the circumferential direction on the outer peripheral surface of the shaft-shaped member. Further, while the nozzle part stops the discharge of the viscous material, the tip of the nozzle part moves in the direction away from the outer peripheral surface of the shaft-shaped member. In this way, the application of the viscous material to the outer peripheral surface of the shaft-shaped member ends.

In the above configuration, the nozzle part may have a connecting portion that is connected to a supply source side for the viscous material, and a curved portion provided on the tip side of the connecting portion and formed in a curved shape.

According to this configuration, the nozzle part has the connecting portion that is connected to the supply source side for the viscous material, and the curved portion formed in a curved shape on the tip side. The tip of the curved portion hits against the shaft-shaped member, whereby the nozzle part having flexibility bends, and therefore, the tip of the nozzle part is pressed against the outer peripheral surface of the shaft-shaped member by an elastic force. Then, when the nozzle part moves, it easily moves in the circumferential direction such that the tip of the nozzle part reliably follows the outer peripheral surface. Further, the viscous material discharged from the tip of the nozzle part easily accumulates between the tip of the nozzle part and the outer peripheral surface of the shaft-shaped member, so that a sufficient amount of viscous material can be supplied to the outer peripheral surface of the shaft-shaped member. Further, when the nozzle part moves, the nozzle part can apply the viscous material to the shaft-shaped member so as to wind around the shaft-shaped member, and the application is reliably performed with a sufficient amount of viscous material.

In the above configuration, the tip of the nozzle part may be inclined with respect to a discharge direction of the viscous material and be open in a direction inclined toward a side opposite to the shaft-shaped member side or a direction inclined toward the shaft-shaped member side.

According to this configuration, when the nozzle part stops the discharge of the viscous material and the tip of the nozzle part moves in the direction away from the outer peripheral surface of the shaft-shaped member, the tip of the nozzle part is separated so as to cut the viscous material. Therefore, the viscous material does not stretch and dripping does not easily occur.

Advantageous Effects of Invention

According to the present invention, it is possible to reliably coat the shaft-shaped member with the viscous material in an appropriate amount.

DESCRIPTION OF EMBODIMENTS

Hereinafter, a seal application apparatus 1 according to an embodiment of the present invention will be described with reference to the drawings.

Figure 1:
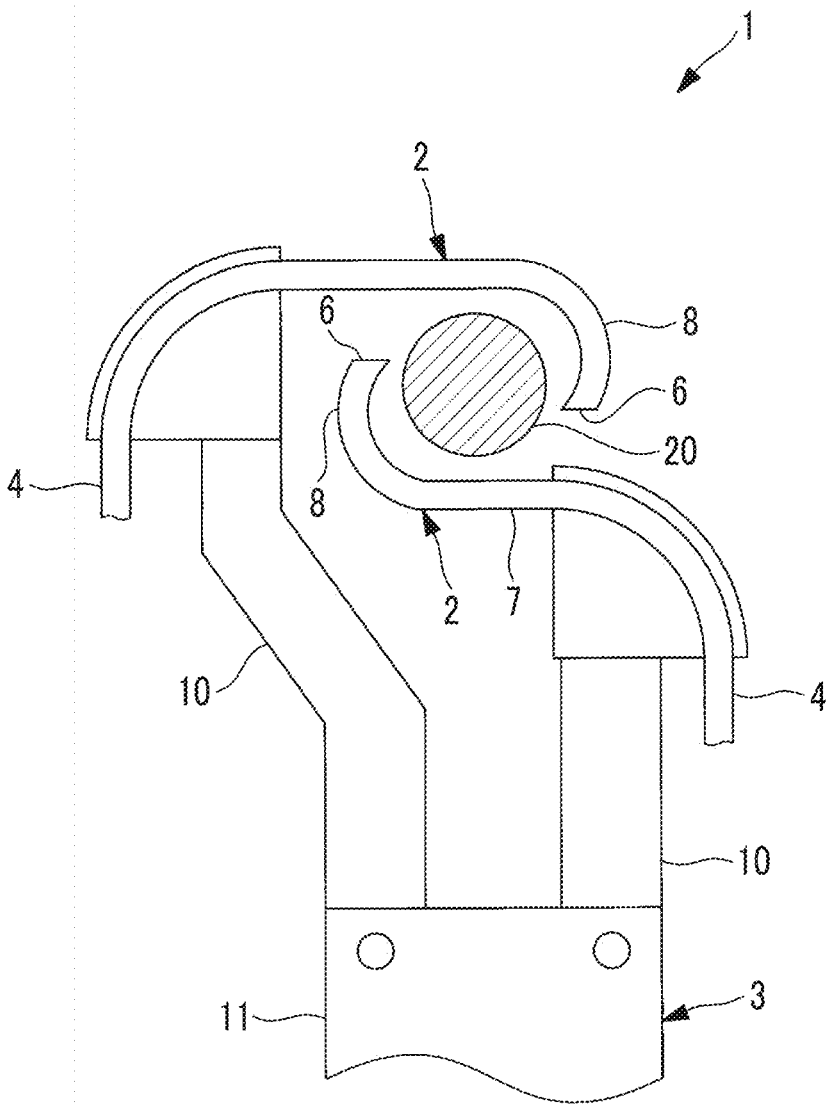
FIG. 1 is a plan view showing a seal application apparatus according to an embodiment of the present invention.
Figure 2:
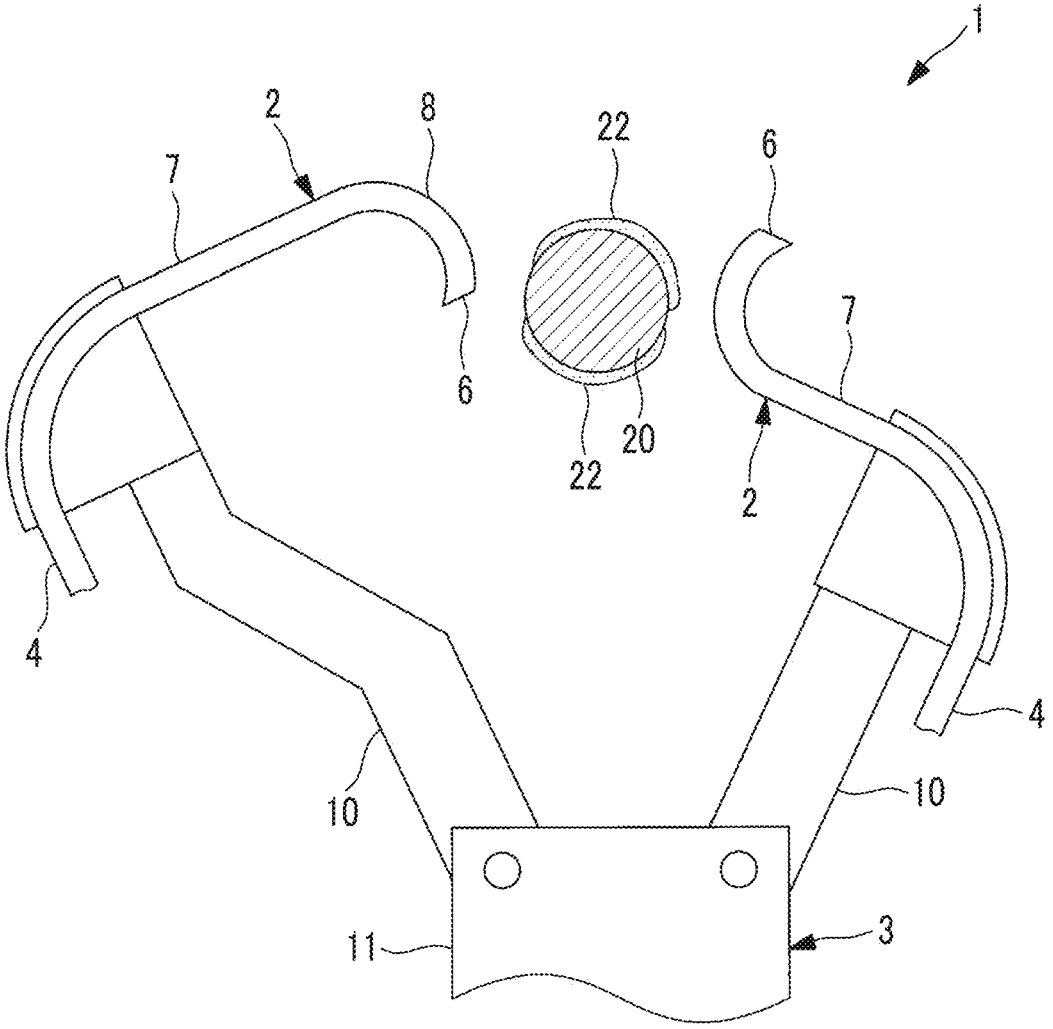
FIG. 2 is a plan view showing the seal application apparatus according to an embodiment of the present invention and shows the state after an arm part has moved.

As shown in FIGS. 1 and 2, the seal application apparatus 1 according to an embodiment of the present invention includes a nozzle 2 that discharges a sealing agent 22, a drive part 3 that moves the nozzle 2, a seal supply pipe 4 for supplying the sealing agent 22 to the nozzle 2, and the like. The seal application apparatus 1 is installed on the tip side of, for example, an automatic fastening apparatus (automatic riveter), and with respect to a fastener (for example, a rivet) 20 before being fastened to a member, the outer peripheral surface of the fastener 20 is coated with the sealing agent 22. The fastener 20 coated with the sealing agent 22 is fastened to the member by the automatic fastening apparatus.

The seal application apparatus 1 discharges the sealing agent 22 to the outer peripheral surface of the fastener 20 before the fastening, which is supported by the tip of the automatic fastening apparatus, and linearly applies the discharged sealing agent 22 along the circumferential direction of the fastener 20.

Two nozzles 2 are installed in the seal application apparatus 1. The nozzle 2 is made of, for example, synthetic resin and has flexibility. The two nozzles 2 are disposed to face each other with the disposition position of the fastener 20, which is a application target, interposed between them.

Figure 6:
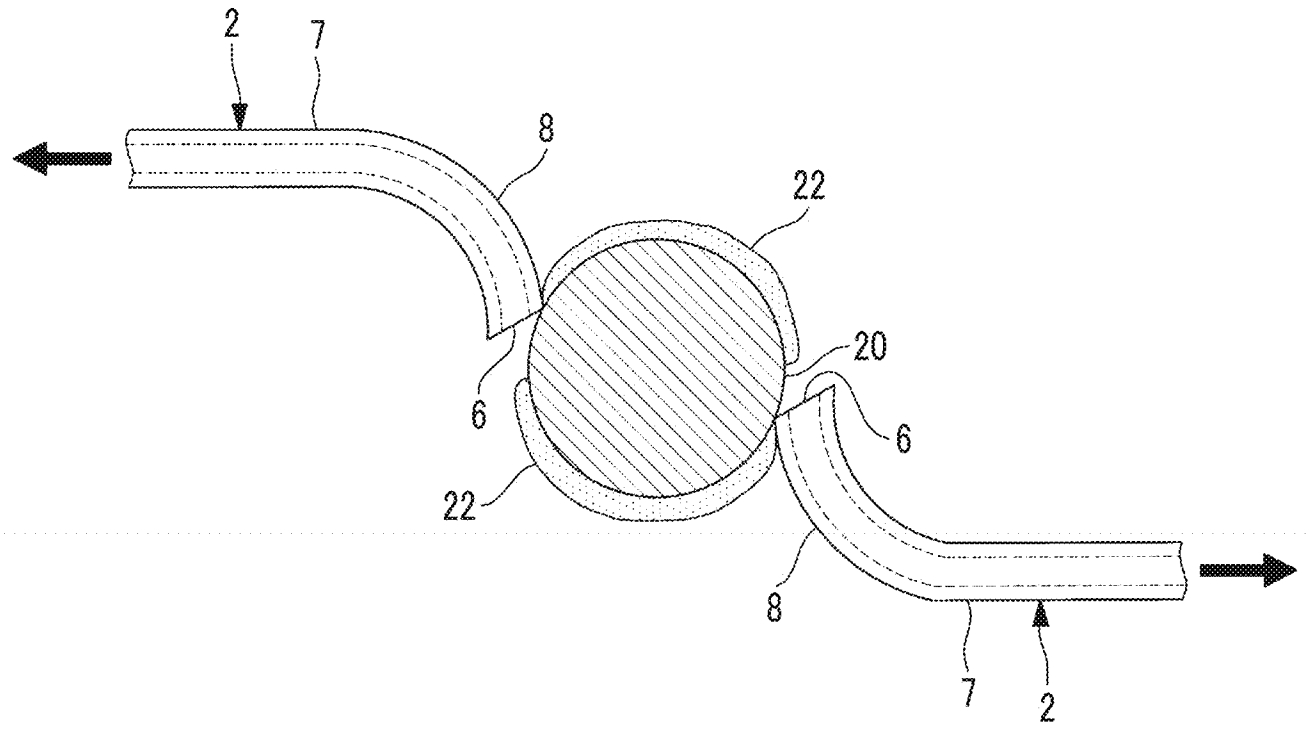
FIG. 6 is a plan view showing the relationship between the nozzle of the seal application apparatus according to an embodiment of the present invention and the fastener and shows the state when the discharge of the sealing agent has ended.
Figure 7:
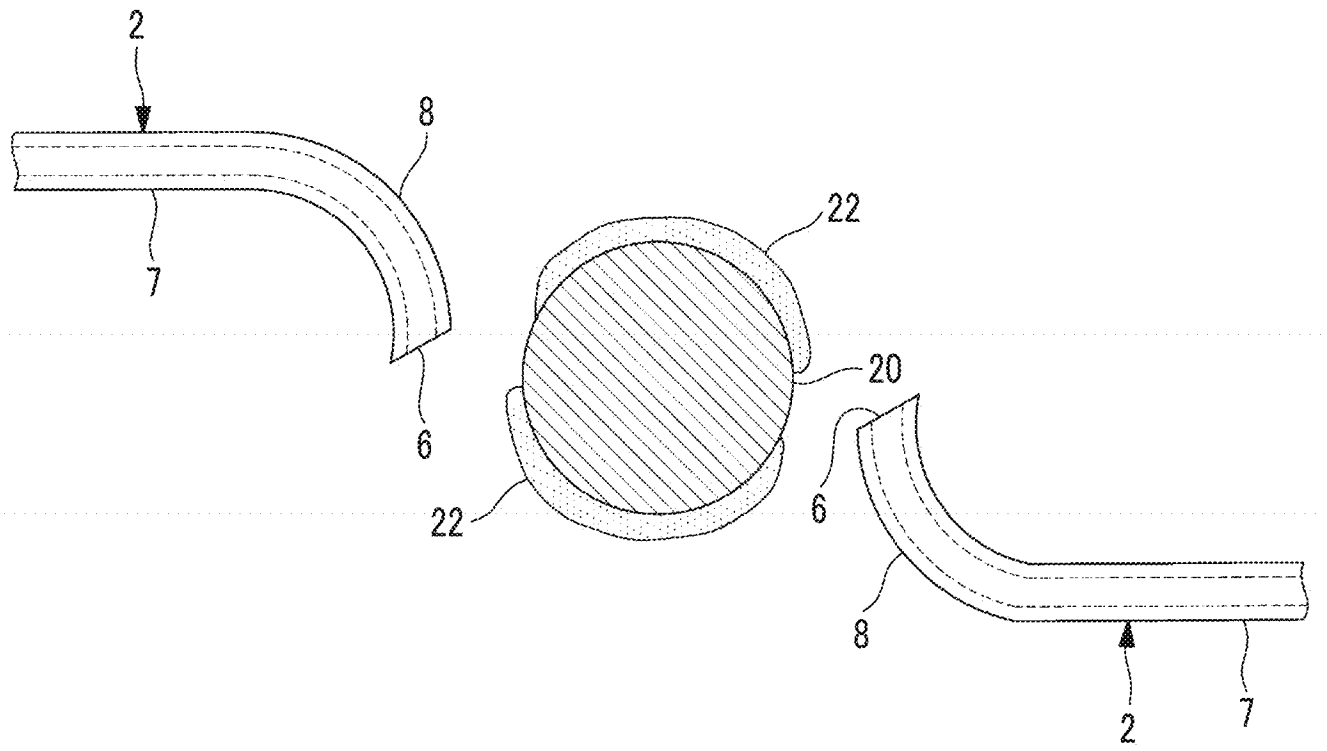
FIG. 7 is a plan view showing the relationship between the nozzle of the seal application apparatus according to an embodiment of the present invention and the fastener and shows the state where the nozzle has been separated from the fastener after the application of the sealing agent.
Figure 8:
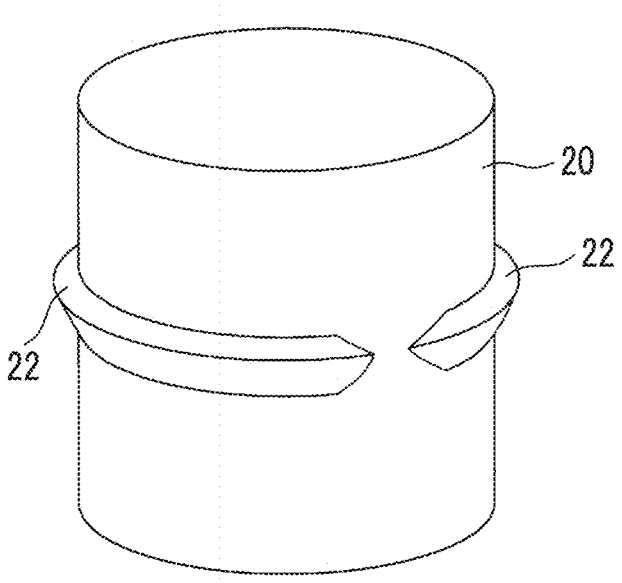
FIG. 8 is a perspective view showing a shaft portion of the fastener coated with the sealing agent by using the seal application apparatus according to an embodiment of the present invention.

The nozzle 2 discharges the sealing agent 22 from an opening 6 formed at the tip thereof. As shown in FIGS. 3 to 7, the nozzle 2 moves from one side to the other side by the drive part 3 with the fastener 20 interposed between the sides. At the time of the application of the sealing agent 22, the fastener 20 and the seal application apparatus 1 are disposed such that a moving direction of the tip of the nozzle 2 is orthogonal to an axial direction of the fastener 20. In this way, as shown in FIG. 8, the sealing agent 22 is applied to a portion intersecting a virtual plane in a direction perpendicular to the axial direction of the fastener 20, on the outer peripheral surface of the fastener 20. At the time of the application of the sealing agent 22, the fastener 20 and the seal application apparatus 1 may be disposed such that the moving direction of the tip of the nozzle 2 is oblique to the axial direction of the fastener 20. In this case, the sealing agent 22 is applied to a portion intersecting a virtual plane in a direction oblique to the axial direction of the fastener 20, on the outer peripheral surface of the fastener 20.

The nozzle 2 has a connecting portion 7 which is connected to the supply source side for the sealing agent 22, and a curved portion 8 formed in a curved shape on the tip side. The curved portion 8 is provided on the tip side of the connecting portion 7 on the extension of the connecting portion 7. The sealing agent 22 flows through the connecting portion 7 and the curved portion 8 in this order and is discharged from the opening 6 at the tip.

One end of the connecting portion 7 of the nozzle 2 is connected to the seal supply pipe 4, and the other end is connected to the curved portion 8. A seal is supplied to the connecting portion 7 through the seal supply pipe 4. The connecting portion 7 is, for example, a linear tubular member. The curved portion 8 is, for example, a tubular member having an arc shape. The curved portion 8 is disposed to be curved toward the fastener 20 side to which the sealing agent 22 is applied. The curved portion 8 has the opening 6 formed at one end thereof, and the other end is connected to the connecting portion 7. The tip surface of the nozzle 2 is inclined with respect to the axial direction of the nozzle 2 and is inclined toward the side opposite to the fastener 20. That is, the angle formed by the tip surface and the outer peripheral surface of the nozzle 2 has an acute angle on the fastener 20 side and an obtuse angle on the side opposite to the fastener 20 when the nozzle 2 is viewed in a plan view. In this way, the opening 6 formed at the tip of the nozzle 2 is open in a direction inclined with respect to the discharge direction of the sealing agent 22.

The inclination direction of the tip surface of the nozzle 2 may be opposite to that in the example described above. That is, the tip surface of the nozzle 2 may be inclined with respect to the axial direction of the nozzle 2 an inclined toward the fastener 20 side. In this case, the angle formed by the tip surface and the outer peripheral surface of the nozzle 2 has an acute angle on the side opposite to the fastener 20 and an obtuse angle on the fastener 20 side when the nozzle 2 is viewed in a plan view.

The two nozzles 2 can move in opposite directions to each other. That is, at the time of the application of the sealing agent 22, in a case where the nozzle 2 on one side moves from one side to the other side, the nozzle 2 on the other side moves from the other side to one side. Further, the two nozzles 2 move at different areas on the outer peripheral surface of the fastener 20. That is, at the time of the application of the sealing agent 22, in a case where the nozzle 2 on one side moves on one side of the outer peripheral surface of the fastener 20, the nozzle 2 on the other side moves on the other side of the outer peripheral surface of the fastener 20. In this way, the two nozzles 2 can move without interfering with each other from the application start to the application end. Further, in one application operation, the sealing agent 22 can be linearly applied over substantially the entire circumference of the outer peripheral surface of the fastener 20 by the two nozzles 2.

The drive part 3 has an arm member 10, a body part 11 that supports the arm member 10, and a drive mechanism (not shown) that is provided on the body part 11 side and moves the arm member 10. The arm member 10 is a rod-shaped member, which supports the nozzle 2 on one end side and is rotatably supported by the body part 11 on the other end side. The arm member 10 rotates around the other end side, whereby the nozzle 2 supported by the arm member 10 moves and the tip of the nozzle 2 moves from one side to the other side with the fastener 20 interposed between the sides.

The drive mechanism for moving the arm member 10 starts the moving operation of the arm member 10 when it receives a signal regarding the start of seal application. Further, when the arm member 10 has reached the maximum movable range after the movement start, the drive mechanism stops the moving operation of the arm member 10. A configuration may be made such that the drive mechanism stops the moving operation of the arm member 10 when it receives a signal regarding the end of the seal application.

The seal application apparatus 1 further includes a seal supply mechanism that controls the discharge of the sealing agent 22. Although not shown in the drawings, the seal supply mechanism has a pump for pumping the sealing agent 22, a valve for adjusting the flow of the sealing agent 22, and the like. When the seal supply mechanism receives the signal regarding the start of the seal application, the seal supply mechanism starts the supply of the sealing agent 22 to the tip of the nozzle 2. Further, the seal supply mechanism stops the supply of the sealing agent 22 to the nozzle 2 when the stop of the moving operation of the arm member 10 has been detected after the arm member 10 starts to move.

Next, a seal application method using the seal application apparatus 1 according to the present embodiment will be described.

Figure 3:
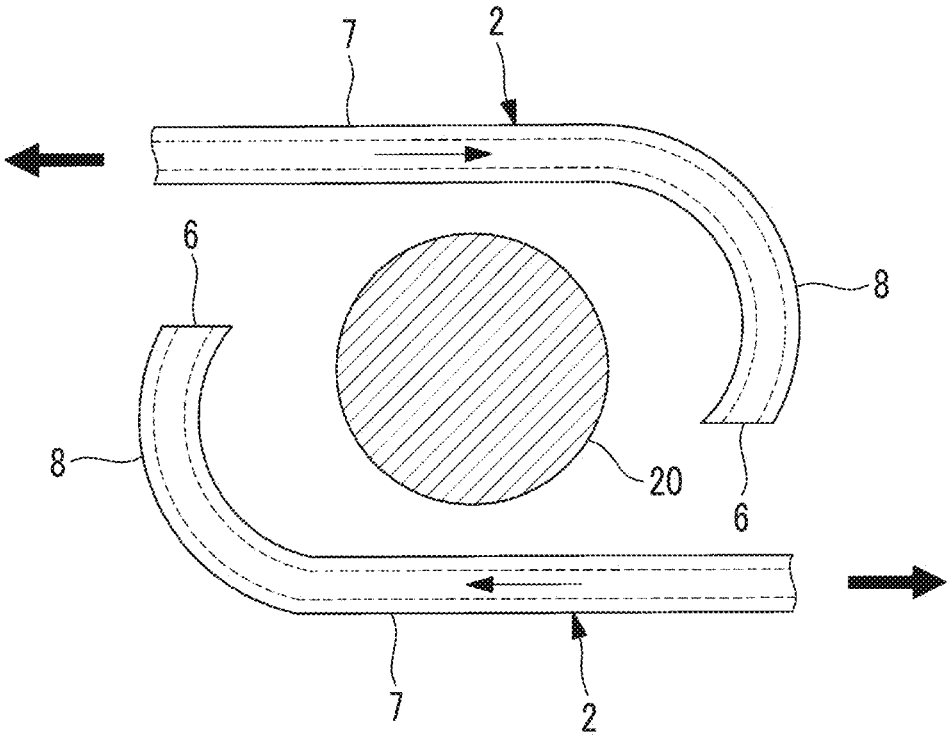
FIG. 3 is a plan view showing the relationship between a nozzle of the seal application apparatus according to an embodiment of the present invention and a fastener and shows the state before a sealing agent is discharged.

First, as shown in FIGS. 1 and 3, the fastener 20 to be coated with the sealing agent 22 is disposed between the two nozzles 2. In the case of the seal application apparatus 1 installed in the automatic fastening apparatus, before fastening, when a state is created where the fastener 20 protrudes from the inside of the automatic fastening apparatus to the tip of the automatic fastening apparatus and is supported at the tip of the automatic fastening apparatus, the fastener 20 is disposed between the two nozzles 2.

Figure 4:
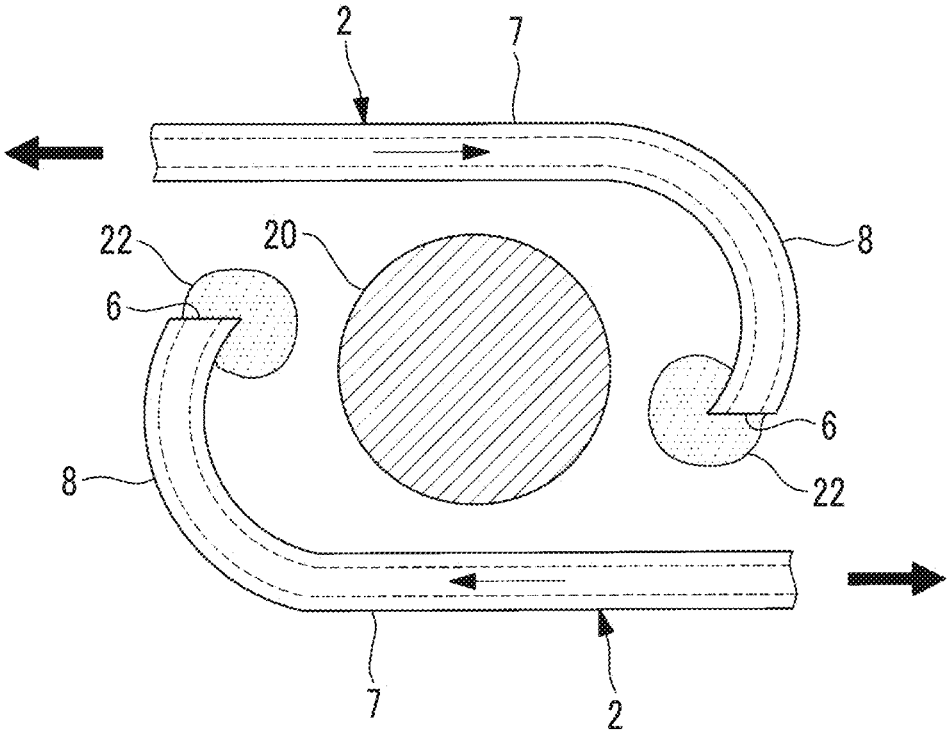
FIG. 4 is a plan view showing the relationship between the nozzle of the seal application apparatus according to an embodiment of the present invention and the fastener and shows the state when discharge of the sealing agent has been started.

Then, when an operation regarding the application start is performed by a user, or when it is detected that the fastener 20 is installed at the tip of the automatic fastening apparatus, the application of the sealing agent 22 is started, as shown in FIG. 4. At this time, the two nozzles 2 operate at the same time.

Figure 5:
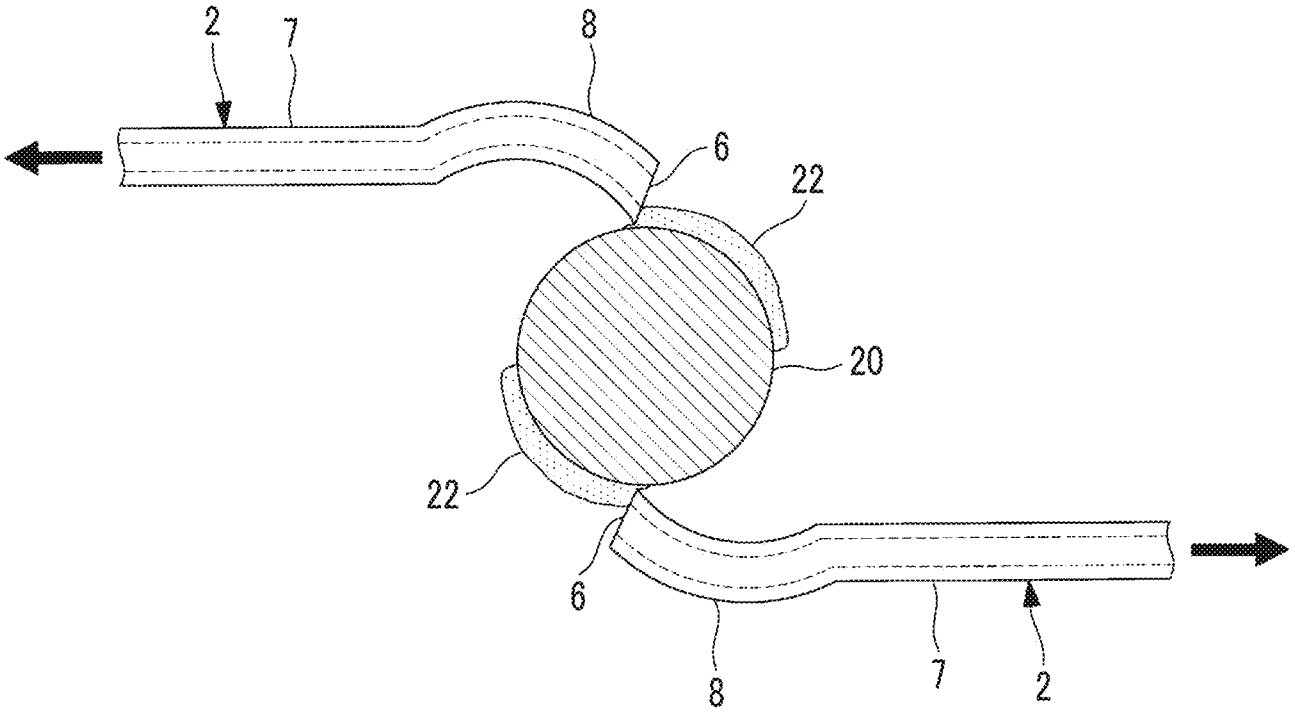
FIG. 5 is a plan view showing the relationship between the nozzle of the seal application apparatus according to an embodiment of the present invention and the fastener and shows the state where the sealing agent is discharged and applied.

When receiving the signal regarding the start of the seal application, the drive mechanism for moving the arm member 10 starts the moving operation of the arm member 10 and the seal supply mechanism starts the supply of the sealing agent 22 to the tip of the nozzle 2. In this way, as shown in FIG. 5, the arm member 10 rotates around the other end side connected to the body part 11 and the sealing agent 22 is discharged from the opening 6 at the tip of the nozzle 2.

Thereafter, while the sealing agent 22 is discharged from the nozzle 2, the nozzle 2 on one side moves from one side to the other side and the nozzle 2 on the other side moves from the other side to one side. As shown in FIG. 6, the discharged sealing agent 22 is applied to the outer peripheral surface of the fastener 20. In one application operation, the sealing agent 22 is applied over approximately half the circumference of the outer peripheral surface of the fastener 20 by one nozzle 2, and the two nozzles 2 operate at the same time, whereby the sealing agent 22 is applied over substantially the entire circumference of the outer peripheral surface of the fastener 20.

Then, when the arm member 10 has reached the maximum movable range after the arm member 10 starts to move, the drive mechanism stops the moving operation of the arm member 10. Further, when the stop of the moving operation of the arm member 10 is detected, the seal supply mechanism stops the supply of the sealing agent 22 to the nozzle 2. In this way, the operation of application of the sealing agent 22 to the fastener 20 by the seal application apparatus 1 ends. Thereafter, as shown in FIG. 7, the nozzle 2 moves to a position away from the fastener 20.

Next, the operation of the nozzle 2 during the application of the sealing agent 22 will be described.

The nozzle 2 is moved by the drive part 3, whereby the tip of the nozzle 2 first approaches toward the outer peripheral surface of the fastener 20.

Next, the tip of the curved portion 8 directly hits against the fastener 20 or indirectly hits against the fastener 20 through the sealing agent 22, whereby the nozzle 2 having flexibility bends, and therefore, the tip of the nozzle 2 is pressed against the outer peripheral surface of the fastener 20 by the elastic force. The tip of the nozzle 2 moves in the circumferential direction along the outer peripheral surface of the fastener 20 while being constantly pressed against the outer peripheral surface of the fastener 20.

After or while the nozzle 2 discharges the sealing agent 22, the tip of the nozzle 2 moves in the circumferential direction along the outer peripheral surface of the fastener 20, whereby the discharged sealing agent 22 is applied in the circumferential direction on the outer peripheral surface of the fastener 20. At this time, since the curved portion 8 is disposed to be curved toward the fastener 20 side to which the sealing agent 22 is applied, the sealing agent 22 discharged from the tip of the nozzle 2 easily accumulates between the tip of the nozzle 2 and the outer peripheral surface of the fastener 20, so that a sufficient amount of sealing agent 22 can be supplied to the outer peripheral surface of the fastener 20. As a result of the movement of the nozzle 2, the sealing agent 22 is applied to the fastener 20 so as to wind around the fastener 20. Further, the application of the sealing agent 22 is reliably performed with a sufficient amount of supplied sealing agent 22.

Finally, while the nozzle 2 stops the discharge of the sealing agent 22, the tip of the nozzle 2 moves in the direction away from the outer peripheral surface of the fastener 20. In this way, the application of the sealing agent 22 to the outer peripheral surface of the fastener 20 ends. The tip of the nozzle 2 is open in the direction inclined with respect to the discharge direction of the sealing agent 22. Therefore, when the nozzle 2 stops the discharge of the sealing agent 22 and the tip of the nozzle 2 moves in the direction away from the outer peripheral surface of the fastener 20, the tip of the nozzle 2 is separated so as to cut the sealing agent 22. Therefore, the sealing agent 22 does not stretch and dripping does not easily occur.

As described above, according to the present embodiment, the nozzle 2 moves from one side to the other side by the drive part 3 with the fastener 20 interposed between the sides, while discharging the sealing agent 22 from the opening 6 formed at the tip thereof. As a result, the sealing agent 22 is linearly applied to a portion intersecting a virtual plane in the direction perpendicular to or oblique to the axial direction of the fastener 20, on the outer peripheral surface of the fastener 20. In this way, unlike an example of the related art in which the sealing agent 22 which is discharged from the nozzle 2 is pressed against the surface of the fastener 20 and the sealing agent 22 is applied in dots, the sealing agent 22 adhered to the tip of the nozzle 2 does not easily drip when the nozzle 2 is separated from the surface of the fastener 20.

Further, since the nozzle 2 having flexibility bends, the tip of the nozzle 2 is pressed against the outer peripheral surface of the fastener 20 by the elastic force. Then, when the nozzle 2 moves, the tip of the nozzle 2 easily moves in the circumferential direction so as to reliably follow the outer peripheral surface. Further, since the curved portion 8 of the nozzle 2 is curved toward the fastener 20, the sealing agent 22 discharged from the tip of the nozzle 2 easily accumulates between the tip of the nozzle 2 and the outer peripheral surface of the fastener 20, so that a sufficient amount of sealing agent 22 can be supplied to the outer peripheral surface of the fastener 20. Further, when the nozzle 2 moves, the nozzle 2 can apply the sealing agent 22 to the fastener 20 so as to wind around the fastener 20, and the application can be reliably performed with a sufficient amount of sealing agent 22.

Furthermore, the tip surface of the nozzle 2 is inclined with respect to the axial direction of the nozzle 2, and the opening 6 formed at the tip of the nozzle 2 is open in the direction inclined with respect to the discharge direction of the sealing agent 22. Therefore, when the nozzle 2 stops the discharge of the sealing agent 22 and the tip of the nozzle 2 moves in the direction away from the outer peripheral surface of the fastener 20, the tip of the nozzle 2 is separated so as to cut the sealing agent 22. Therefore, the sealing agent 22 does not stretch and dripping does not easily occur.

As described above, in the present embodiment, at the time of the end of the application of the sealing agent 22 when the nozzle 2 is separated from the fastener 20, the dripping of the sealing agent 22 does not easily occur. As a result, it is possible to avoid a problem in that the fastening force of the member by the fastener 20 is lowered due to the sealing agent 22 dripping and adhering to an area where the application of the sealing agent 22 is unnecessary or prohibited. Further, since it is not necessary to consider the occurrence of the dripping of the sealing agent 22 and it is not necessary to reduce the amount of the sealing agent 22 to be discharged, a problem in that the sealing agent 22 cannot be sufficiently applied also does not easily occur.

In the embodiment described above, the seal application apparatus 1 for application the sealing agent 22 to the fastener 20 has been described. However, the present invention is not limited to this example. The application target is not limited to only a fastening member such as a fastener, and it is also possible to adopt a shaft-shaped member having a tubular shape or a rod shape, other than the fastening member. Further, a material to be applied to the application target is not limited to the sealing agent 22 and may be a viscous material such as an adhesive agent.

Further, in the embodiment described above, the configuration has been described in which the tip of the nozzle 2 has the curved portion 8 and the arm member 10 rotates around the other end side, so that the sealing agent 22 is applied in the circumferential direction along the outer peripheral surface of the fastener 20. However, the present invention is not limited to this example. Another configuration may be adopted as long as it is a configuration made such that after or while a nozzle part having flexibility discharges a viscous material, the tip of the nozzle part moves in the circumferential direction along the outer peripheral surface of a shaft-shaped member, and thereafter, the tip of the nozzle part moves in the direction away from the outer peripheral surface of the shaft-shaped member.

REFERENCE SIGNS LIST

1: seal application apparatus
2: nozzle
3: drive part
4: seal supply pipe
6: opening
7: connecting portion
8: curved portion
10: arm member
11: body part
20: fastener
22: sealing agent

The invention claimed is:

1. A viscous material application apparatus comprising:

tubular nozzle parts having flexibility and capable of discharging a viscous material from an opening formed at tips thereof; and a drive part that moves the nozzle parts, wherein the nozzle parts comprise:

a first nozzle part and a second nozzle part disposed opposite each other with a cylindrically-shaped member interposed therebetween, wherein the first nozzle part and the second nozzle part each comprise:

a connecting portion that is connected to a supply source side for the viscous material, and a curved portion provided closer to the tips of the nozzle parts than the connecting portion formed such that a central axis of the nozzle parts is curved along an outer peripheral surface of the cylindrically-shaped member, and wherein after or while the nozzle parts discharge the viscous material, the nozzle parts having flexibility bend, and the tips of the nozzle parts move in a circumferential direction along an outer peripheral surface of the cylindrically-shaped member, and while the nozzle parts stop discharge of the viscous material, the tips of the nozzle parts move in a direction away from the outer peripheral surface of the cylindrically-shaped member.

2. The viscous material application apparatus according to claim 1, wherein the tips of the nozzle parts are inclined with respect to a discharge direction of the viscous material and are open in a direction inclined toward a side opposite to the cylindrically-shaped member side or a direction inclined toward the cylindrically-shaped member side.

* * * * *